US006393791B1

(12) United States Patent
Mann

(10) Patent No.: US 6,393,791 B1
(45) Date of Patent: May 28, 2002

(54) FREESTANDING WALL

(76) Inventor: Kenneth N. Mann, 16180 Herring Rd., Colorado Springs, CO (US) 80908

( * ) Notice: Subject to any disclaimer, the term of this patent is extended or adjusted under 35 U.S.C. 154(b) by 0 days.

(21) Appl. No.: 09/523,479

(22) Filed: Mar. 10, 2000

(51) Int. Cl.[7] ..... E04B 9/00; E06B 3/54

(52) U.S. Cl. ..... 52/478; 52/479; 52/481.1; 52/483.1; 52/781.3; 52/300; 256/59; 256/65; 256/24

(58) Field of Search ..... 52/478, 479, 481.1, 52/483.1, 781.3, 762, 281, 690, 299, 300; 256/59, 65, 24

(56) References Cited

U.S. PATENT DOCUMENTS

| | | | | | |
|---|---|---|---|---|---|
| 2,140,689 | A | * | 12/1938 | Collins | 52/144 |
| 3,963,219 | A | * | 6/1976 | D'Amico | 256/24 |
| 4,084,367 | A | * | 4/1978 | Saylor et al. | 52/615 |
| 5,029,425 | A | * | 7/1991 | Bogataj | 52/482 |
| 5,136,821 | A | * | 8/1992 | Child | 52/144 |
| 5,400,563 | A | * | 3/1995 | House et al. | 52/745.1 |
| 5,435,669 | A | * | 7/1995 | Weber | 52/604 |
| 5,501,057 | A | * | 3/1996 | Dawson | 52/761 |
| 5,671,913 | A | * | 9/1997 | Vesper | 256/31 |
| 5,765,333 | A | * | 6/1998 | Cummingham | 52/481.1 |
| 6,112,473 | A | * | 9/2000 | Pingel | 52/79.1 |
| 6,227,523 | B1 | * | 5/2001 | Haberlen | 256/59 |
| 2001/0002529 | A1 | * | 6/2001 | Commins et al. | 52/481.1 |

OTHER PUBLICATIONS

Allen Block, Nova Brick Mortarless Technology, 1998.

* cited by examiner

*Primary Examiner*—Carl D. Friedman
*Assistant Examiner*—Dennis L. Dorsey
(74) *Attorney, Agent, or Firm*—Mark G. Pannell; Hanes & Schutz, P.C.

(57) ABSTRACT

A freestanding wall is constructed by erecting at least two upright supports. The upright supports are either posts or columns. Upper and lower horizontal structure members are fastened to the upright supports. Vertical intermediate framing members are secured between the upper horizontal structure member and the lower horizontal structure member. Cladding is attached to at least the front and optionally the back of each vertical intermediate framing member to conceal each vertical intermediate framing member. The upper horizontal structure member is then covered with a cap.

17 Claims, 3 Drawing Sheets

FREESTANDING WALL

The present invention relates in general to a freestanding wall, and more particularly to, a freestanding wall structure having a frame covered with cladding.

BACKGROUND

Freestanding walls have a variety of purposes. They are often used for privacy, decoration, and sound attenuation. Additionally, there are numerous methods for constructing freestanding walls. For example, freestanding walls are often constructed from pre-cast concrete, mortared and mortarless masonry, or wooden slats supported by a frame. Each of these methods has advantages and disadvantages.

Pre-cast concrete and mortared masonry walls are often expensive to construct, but once constructed are very sturdy and lasting. Wooden walls are less expensive to construct, but are not as sturdy or lasting and provide little sound attenuation.

It has long been a practice to clad the outside of buildings with masonry materials, for example, roofing tile and brick and stone veneer. The masonry materials provide insulation, water penetration resistance, and sound attenuation. Cladding a framework provides many of the benefits of masonry at a lower cost than a structure constructed entirely from masonry.

SUMMARY OF THE INVENTION

According to principles of the present invention, a freestanding wall is constructed by erecting at least two upright supports. The upright supports are either posts or columns. Upper and lower horizontal structure members are fastened to the upright supports. Vertical intermediate framing members are secured between the upper horizontal structure member and the lower horizontal structure member. Cladding is attached to the front and optionally to the back of each vertical intermediate framing member to conceal the lower horizontal structure member and each vertical intermediate framing member. The upper horizontal structure member is then covered with a cap.

According to further principals of the present invention, a starter strip is attached to the lower horizontal structure member. A first row of cladding is then stacked upon the starter strip. Subsequent rows are stacked upon the first row until the cladding conceals the lower horizontal structure member and the vertical intermediate framing members. The rows of cladding are periodically secured to the vertical intermediate framing members as needed for structural integrity.

Other objects, advantages, and capabilities of the present invention will become more apparent as the description proceeds.

DETAILED DESCRIPTION

Figure 1:
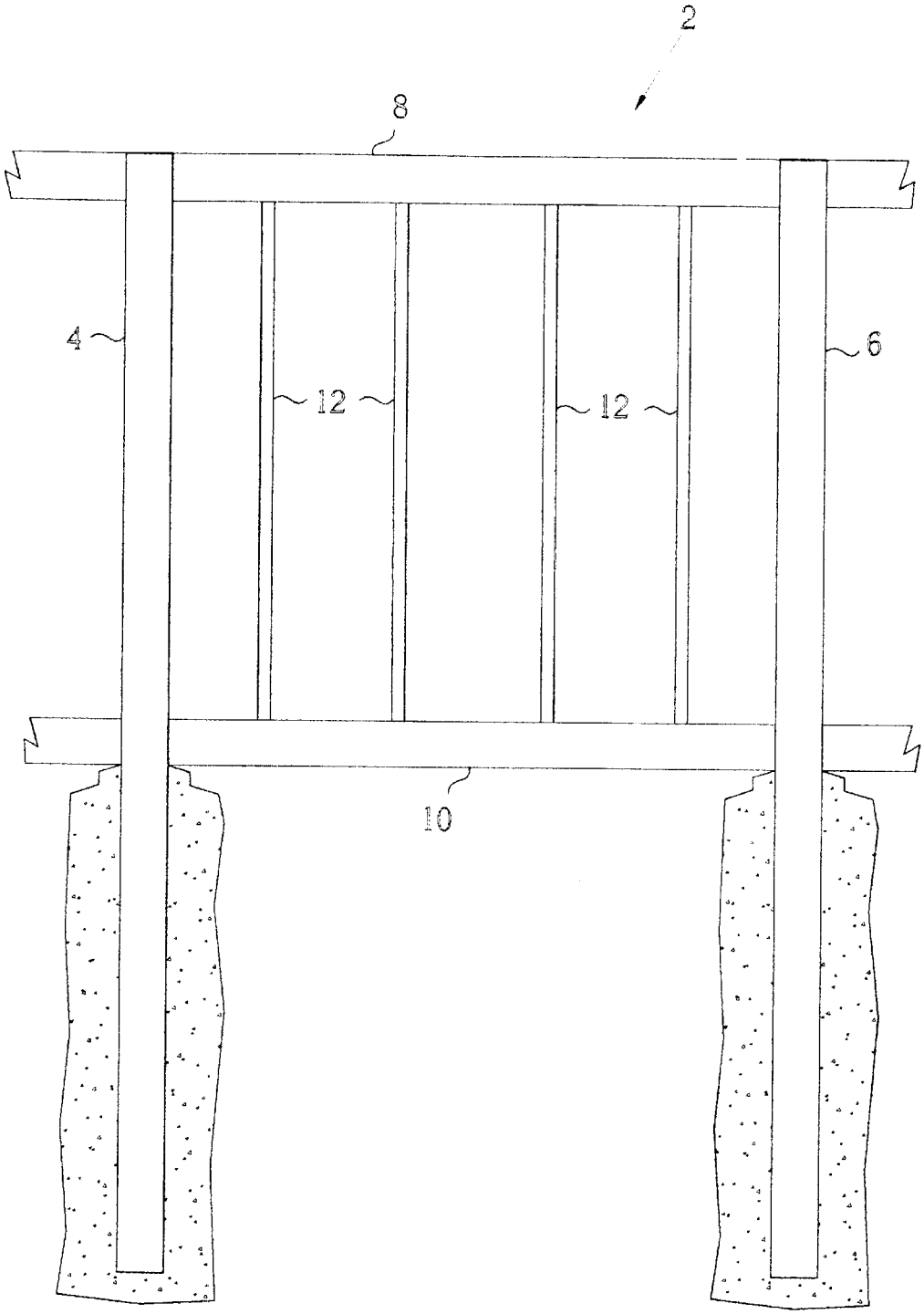
FIG. 1 is a illustrative diagram depicting a framework of the present invention freestanding wall.

FIG. 1 illustrates a frame 2 for a freestanding wall. Frame 2 includes upright supports 4, 6; horizontal structure members 8, 10; and vertical intermediate framing members 12. Frame 2 is constructed from any structurally capable material. For example, frame 2 may be constructed from wood, metal, plastic, or concrete. Additionally frame 2 may be constructed from more than one type of material.

Horizontal structural members 8, 10 are attached to the upright supports 4, 6. Upper horizontal structural member 8 is attached at the upper end of upright supports 4, 6. Lower horizontal structure member 10 is attached at the base of upright supports 4, 6. The base of upright supports 4, 6 is the lowest portion of upright supports 4, 6 that is above ground. Vertical intermediate framing members 12 are secured to upper horizontal structural member 8 and lower horizontal structural member 10.

Figure 2:
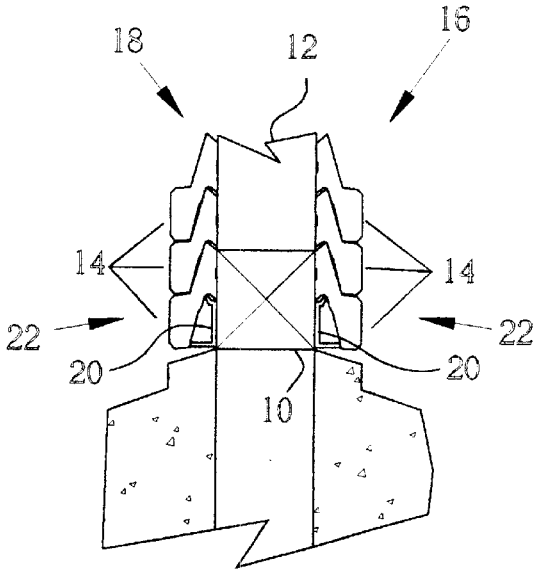
FIG. 2 is a fragmentary cross-sectional view illustrating the cladding installation on the freestanding wall in FIG. 1.

FIG. 2 illustrates one embodiment for the attachment of cladding 14 to vertical intermediate framing members 12. For the purpose of ease of reference, one side of both lower horizontal structural member 10 and vertical intermediate framing members 12 will be referred to as the front 16. The opposite side will be referred to as the back 18. Treatment of the front 16 and the back 18 may be identical or different depending on preference. For example, front 16 may be clad while back 18 remains unclad or clad in an alternative manner.

A starter strip 20 is attached to the front 16 and back 18 lower horizontal structural member 10. A first row 22 of cladding 14 is secured to the front 16 and back 18 of either lower horizontal structural member 10 or the lower end of vertical intermediate framing members 12.

Subsequent rows of cladding 14 are stacked upon the first row 22 of cladding 14 until horizontal structural member 10 and vertical intermediate framing members 12 are covered. Cladding 14 is attached to vertical intermediate framing members 12 as necessary to secure cladding 14 to frame 2. The cladding is preferably installed without mortar and is secured to the framing with screws or other suitable fasteners. Cladding 14 may be constructed from any appropriate product. For example, the product Nova Brik™ is an acceptable cladding 14.

In an alternate embodiment, horizontal structure members 8, 10 and vertical intermediate framing members 12 are omitted from frame 2. Cladding 14 is attached directly to upright supports 4, 6, which are spaced to conveniently, attach cladding 14.

Optionally, frame 2 may be filled with an insulator (not shown). The insulator may be placed between vertical intermediate framing members 12 and between vertical intermediate framing members 12 and upright supports 4, 6. The insulator may be any suitable material such as rice or wheat straw, shredded tires, saw dust, sand or gravel, or foam. The insulator would add to the sound attenuation properties of the wall.

Figure 3:
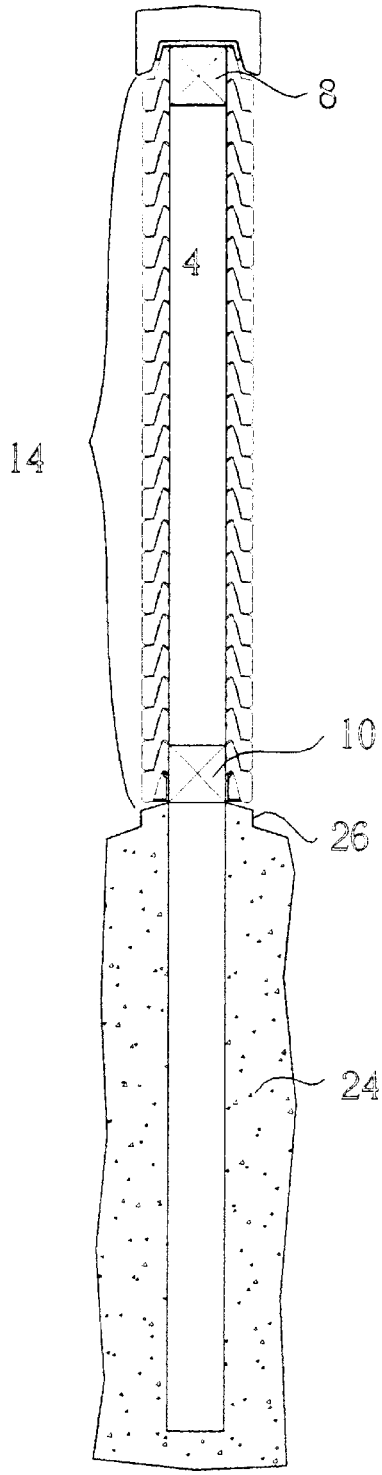
FIG. 3 is a cross-sectional view of a post in the wall of the present invention.

Upright supports 4, 6 are any structure for providing support to frame 2. In one embodiment, upright supports 4, 6 are posts. FIG. 3 illustrates upright support 4 as a post 4. Post 4 is installed in a hole 24 of sufficient diameter and depth to ensure post 4, once installed, may resist all imposed loads. Hole 24 may be filled with reinforced or plain concrete. Alternatively, the concrete may be omitted or other suitable material such as gravel may be placed around post 4.

Additional concrete, masonry, or other suitable waterproofing material 26 is installed at the base of post 4 up to the bottom of lower horizontal structural member 10 to provide protection from exposure to moisture. Installing the concrete, masonry, or other suitable waterproofing material 26 seals the bottom of lower horizontal structural member 10. Where this protection is not necessary, this step may be omitted.

Figure 4:
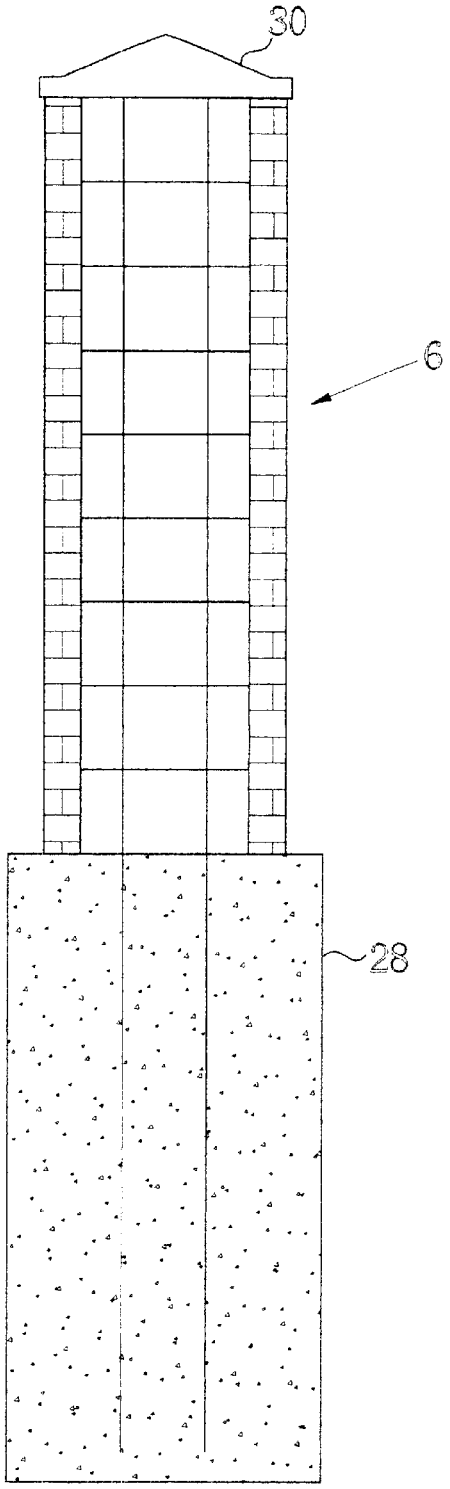
FIG. 4 is a cross-sectional view of a column in the wall of the present invention.

In an alternate embodiment, upright supports 4, 6, are columns. FIG. 4 illustrates upright support 6 as a column 6. Column 6 may be decorative masonry or pre-cast concrete columns. Column 6 may be used in lieu of or in addition to the normal posts 4. Column 6 may be constructed of concrete, masonry products, clay brick, artificial stone, natural stone, or other similar products. Column 6 may be constructed using concrete masonry units as a core then a veneer of clay brick, natural or artificial stone, stucco, or other masonry products installed over the core. The core of concrete masonry units is not necessary in all types of construction. In some cases, a concrete grout may be used in the core of column 6. Pre-cast concrete columns may also be used as the decorative column 6.

A foundation 28 for decorative column 6 is preferably installed to a sufficient depth into the ground to resist imposed forces on the panels. Column 6 may be capped 30 with a number of different products including metal flashing, vinyl pre-cast caps, pre-cast concrete units, artificial and natural stone, clay brick, and other similar masonry products.

Figure 5:
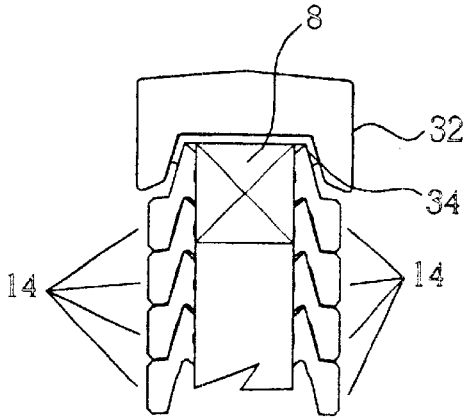
FIG. 5 is a fragmentary cross-sectional view illustrating the top of the wall and the cap.

FIG. 5 illustrates one embodiment for finishing the top of the freestanding wall. At least one cap 32 is placed atop upper horizontal structure member 8. A thin layer of flashing 34 such as reinforced vinyl plastic sheeting material is first laid over the top of upper horizontal structure member 8 and cladding 14. Flashing 32 is of sufficient width to ensure water will not penetrate behind cladding 14 to reach upper horizontal structure member 8 or vertical intermediate framing member 12. Once flashing 34 is installed cap 32 is positioned over the top of upper horizontal structure member 8 and cladding 14. An elastic caulking may be required where cap 32 abuts upright supports 4, 6 to ensure water does not penetrate to the frame 2. Cap 32 may be secured or mechanically locked or laid loose onto the top of upper horizontal structure member 8 and cladding 14.

Cap 32 may be constructed from a number of different products including specially shaped concrete masonry cap units, pre-molded vinyl shapes, pre-molded metal shapes, and pre-molded artificial and natural stone units. Cap 32 may also be constructed of pre-cast concrete sections of various lengths, molded plastic, molded vinyl, molded metal, natural stone, and clay brick.

Figure 6:
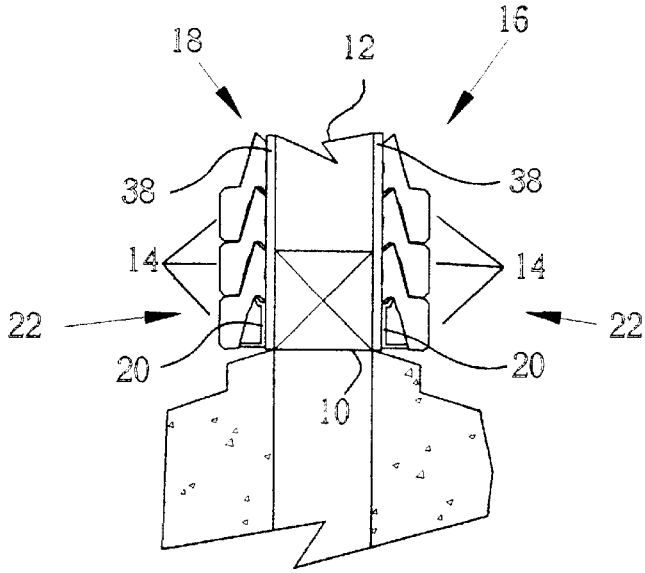
FIG. 6 illustrates an alternate embodiment for attaching cladding to the frame of the wall.

FIG. 6 illustrates an alternate embodiment for attaching cladding 14 to vertical intermediate framing members 12. A sheathing 38 is attached to vertical intermediate framing members 12. Cladding 14 is then attached to sheathing 38 to cover sheathing 38.

In the embodiment without horizontal structure members 8, 10 and vertical intermediate framing members 12, sheathing 38 is attached to upright supports 4, 6. Cladding 14 is then attached to sheathing 38 to cover sheathing 38.

It should be understood that the foregoing description is only illustrative of the invention. Various alternatives and modifications may be devised by those skilled in the art without departing from the invention. Accordingly, the present invention is intended to embrace all such alternatives, modifications, and variances that fall within the scope of the appended claims.

What is claimed is:

1. A freestanding wall comprising:

(a) first and second upright supports each having an upper end and a base;

(b) an upper horizontal structure member fastened to the first and second upright supports proximate the upper end of the first and second upright supports, the upper horizontal structure member having a top surface;

(c) a lower horizontal structure member fastened to the first and second upright supports proximate the base of the first and second upright supports;

(d) at least one vertical intermediate framing member secured between the upper horizontal structure member and the lower horizontal structure member, each vertical intermediate framing member having a front and a back;

(e) cladding attached to the front of each vertical intermediate framing member to conceal the front of each vertical intermediate framing member, the cladding having an upper end; and, (f) a cap covering the top surface of the upper horizontal structure member and capturing the upper end of the cladding between the upper horizontal structure member and the cap.

2. The freestanding wall of claim 1 further including flashing between the upper horizontal structure member and the cap.

3. The freestanding wall of claim 1 wherein the first and second upright supports include first and second posts.

4. The freestanding wall of claim 3 the first and second posts are set in concrete.

5. The freestanding wall of claim 1 wherein the first and second upright supports include first and second columns.

6. The freestanding wall of claim 4 further including at least one solid footing supporting the first and second columns.

7. The freestanding wall of claim 1 further including sheathing attached between the cladding and the front of each vertical intermediate framing member.

8. The freestanding wall of claim 1 further including cladding attached to the back of each vertical intermediate framing member to conceal the back of each vertical intermediate framing member.

9. The freestanding wall of claim 8 further including sheathing attached between the cladding and the back of each vertical intermediate framing member.

10. The freestanding wall of claim 8 further including insulation filling the freestanding wall between the cladding attached to the front and the back of each vertical intermediate framing member.

11. The freestanding wall of claim 1 further including a seal covering the lower horizontal structure member.

12. A freestanding wall comprising:

(a) first and second upright supports each having a front and a back, the first and second upright supports each having an upper end;

(b) cladding attached to the front and the back of the first and second upright supports to conceal the front and the back of the first and second upright supports, the cladding having an upper end; and, (c) a cap bridging the cladding attached to the front of the first and second upright supports and the cladding attached to the back of the first and second upright supports, the upper end of the cladding captured between the upper ends of the first and second upright supports and the cap.

13. The freestanding wall of claim 12 further including flashing between the cladding and the cap.

14. The freestanding wall of claim 12 wherein the first and second upright supports include first and second posts.

15. The freestanding wall of claim 12 wherein the first and second upright supports include first and second columns.

16. The freestanding wall of claim 12 further including sheathing attached between the cladding and the front and back of the first and second upright supports.

17. The freestanding wall of claim 12 further including insulation filling the freestanding wall between the cladding attached to the front and the back of the first and second upright supports.

* * * * *